US005810267A

United States Patent [19]

Karasawa

[11] Patent Number: 5,810,267

[45] Date of Patent: Sep. 22, 1998

[54] METHOD AND APPARATUS FOR PULVERIZING SOLID PARTICLES

[76] Inventor: Yukihiko Karasawa, 3-27 Oaza-Minami-Nakano, Ohmiya-shi, Saitama 330, Japan

[21] Appl. No.: 720,471

[22] Filed: Sep. 30, 1996

[30] Foreign Application Priority Data

Sep. 29, 1995 [JP] Japan ..... 7-253401

[51] Int. Cl.[6] ..... B02C 19/06

[52] U.S. Cl. ..... 241/5; 241/39

[58] Field of Search ..... 241/5, 39, 40

[56] References Cited

U.S. PATENT DOCUMENTS

| | | | |
|---|---|---|---|
| 3,545,683 | 12/1970 | Schulte | 241/5 |
| 4,883,218 | 11/1989 | Wohlenberg | 241/5 |
| 4,934,608 | 6/1990 | Sylla et al. | 241/5 |
| 5,380,089 | 1/1995 | Karasawa . | |

FOREIGN PATENT DOCUMENTS

| | | | |
|---|---|---|---|
| 3231465 | 3/1984 | Germany | 241/5 |
| 647264 | 4/1992 | Japan . | |
| 6278030 | 5/1993 | Japan . | |
| 1175555 | 8/1985 | U.S.S.R. | 241/5 |
| 2273670 | 6/1994 | United Kingdom | 241/5 |

*Primary Examiner*—Mark Rosenbaum
*Attorney, Agent, or Firm*—Gottlieb, Rackman & Reisman

[57] ABSTRACT

In an apparatus and a method, a suspension of fluid using a fluid under supercritical state as a dispersion medium is pulverized to obtain fine particles. Solid particles are suspended in the fluid under supercritical or subcritical state, which is in a gaseous state at normal temperature. Thus, pressure on the suspension fluid is increased, and the suspension fluid under high pressure thus obtained is injected through a nozzle and collided at high speed to disperse and pulverize. Then, pressure on the suspension fluid is reduced, and the fluid under supercritical or subcritical state is vaporized and solid particles are separated. As a result, efficient pulverizing can be performed, and it is possible to prevent agglomeration of particles in drying process.

2 Claims, 6 Drawing Sheets

METHOD AND APPARATUS FOR PULVERIZING SOLID PARTICLES

BACKGROUND OF THE INVENTION

The present invention relates to an apparatus for wet pulverization and drying of powder, and in particular, to an apparatus for producing and drying fine particles using a supercritical fluid as a suspension medium or a solvent.

As the technique to pulverize powder, there have been known a method to use a disintegrating medium and a method not to use it. Also known are a dry method to process powder in the air or in other vapor phase, and a wet method to process powder in various type of liquid. The term "pulverizing" in the present invention means to disperse particles in an agglomerate or in an agglomerated state to individual particles or to a small agglomerate, and also to reduce the particles to smaller particle size.

In the disintegrating technique to use a disintegrating medium, there are problems in that it is difficult to reduce powder down to the order of a submicron because the pulverization is limited by the size of the disintegrating medium, and that, because the disintegrating medium itself is worn out in the process of pulverization, fine particles produced by wearing are intermingled as foreign objects and the purity of the powder to be obtained is decreased.

On the other hand, as the method not to use the disintegrating medium, there are a wall collision type pulverizing method, in which a jet air flow is generated by compressed air, material particles are accelerated and are crashed against a collision plate, and an opposed collision type pulverizing method to make the material particles crash against each other. However, these methods are extremely low in energy efficiency and it is difficult to turn the powder down to the order of a submicron despite long-term processing. In contrast, according to the wet method, a fluid having material powder dispersed in it is pressurized and is injected through nozzle, or a fluid having the material powder pressurized at extra-high pressure is pulverized by wall collision or by opposed collision. In the wet method, it is necessary to adopt various types of techniques relating to extra-high pressure to solve the problems caused by high liquid phase viscosity and a low diffusion coefficient, and the method can be achievable only after these problems have been solved. The present applicants have already proposed an emulsifying apparatus for obtaining dispersion liquid of particles or a nozzle for solid-liquid mixed phase flow used for the emulsifying apparatus in U.S. Pat. No. 5,380,089 (JP(A) 6-47264 and JP(A) 6-278030).

Using these apparatuses, it is possible to obtain a fluid having particles evenly dispersed in it, but there must be a drying process in case powder is to be separated from the fluid having particles dispersed in it. In a general drying process, the fluid having particles dispersed in it is released under high pressure into drying furnace and is dried. The speed to inject it into the drying furnace is one several hundredth of flow velocity of the fluid obtained by the emulsifying or dispersion method as described above. As a result, when it is released into the drying furnace, particles are already agglomerated in a larger size, and particles may be bonded together while dropping down through the drying furnace. As a result, most of the objects are collected as spherical agglomerates, and it is impossible to maintain the initial particle size.

It is therefore an object of the present invention to provide an apparatus and a method, by which it is possible to improve pulverization efficiency by collision of a fluid containing dispersed powder and to separate the powder without causing re-agglomeration of fine particles from the fluid having particles dispersed in it.

SUMMARY OF THE INVENTION

To attain the above object, the method for pulverizing solid particles according to the present invention comprises the steps of suspending solid particles in a fluid under a supercritical or subcritical state, which is in a gaseous state at normal temperature, pressurizing the suspending fluid, injecting the high pressure suspension fluid thus obtained through a nozzle and crashing it at high speed to pulverize, reducing the pressure on the suspension fluid, and turning the fluid under the supercritical or subcritical state to a gaseous state to separate it from the solid particles.

The apparatus for pulverizing solid particles according to the present invention comprises a material adjusting means for adjusting a suspension fluid with solid particles suspended in it, i.e. a fluid under supercritical or subcritical state, which is in a gaseous state at normal temperature, a pressurizing means for pressurizing the suspension fluid, a pulverizing means for injecting the pressurized suspension fluid through a nozzle and for crashing at high speed, and a separating means for separating solid particles by reducing pressure on the suspension fluid.

DESCRIPTION OF THE PREFERRED EMBODIMENT

Figure 1:
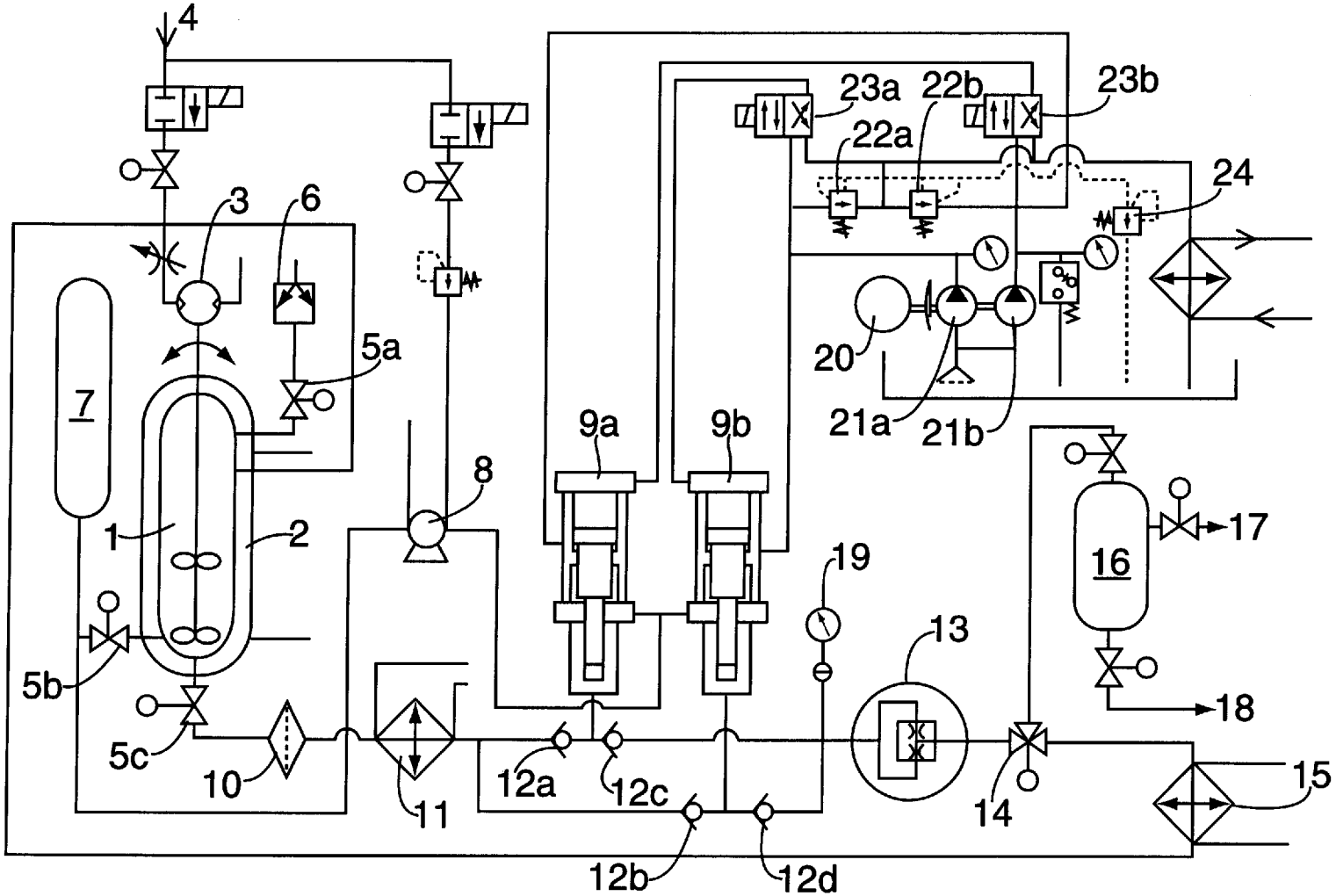
FIG. 1 is a block diagram showing an apparatus for producing fine particles of the present invention.

According to the present invention, the powder to be pulverized is suspended in a fluid, which is under supercritical state or under subcritical state where either temperature or pressure is near the critical point and not exceeding the critical point by adjusting temperature and pressure. After performing processing of pulverization through collision of the suspension fluid by a predetermined number of times, pressure on the particle suspension fluid is reduced to vaporize the fluid and to separate fine particles instantaneously.

When wet pulverizing is performed using water as the suspension fluid, viscosity of the water is 1 cP, and diffusion coefficient is $10^{-5}$ $cm^2$/sec. On the other hand, when a dry method is performed in the air, viscosity of the air is about 0.02 cP, and diffusion coefficient is 0.1 to 1 $cm^2$/sec. When simple comparison is made on pulverizing between the wet method and the dry method, it is known that the dry pulverization is by 50 times more advantageous in viscosity, and by 1000 to 10000 times more advantageous in diffusion coefficient than the wet pulverization.

This could be understood from the fact that, in case of wet dispersion pulverizing, relatively high pressure is required compared with that of a mathematical expression. In case of a suspension liquid, collision occurs due to high velocity flow caused by high pressure and collision energy may be reduced because the liquid phase acts as a buffer at the instant of pulverizing.

On the other hand, in case of the dry method, which is advantageous in terms of diffusion and viscosity, when it is attempted to increase pressure on gas to high pressure, there are various regulatory restrictions for safety purposes. This requires a larger scale apparatus, and the accelerated solid components pass through the portion of the acceleration nozzle where velocity of the outermost flow is at the slowest. There is also a problem of wearing of the side surface of the nozzle pipe, and it is inefficient because only the vapor phase passes through the high velocity region at the center.

In this respect, the present inventors have taken special notice of supercritical fluid, which may be called a third fluid. The supercritical fluid has viscosity and a diffusion coefficient close to those of gas. In a suspension liquid or solvent of this supercritical fluid, the diffusion coefficient is higher than in the liquid, and migration velocity of the substance is hence higher. The buffer effect at the collision is also reduced because viscosity is low. As a result, pulverizing efficiency in the pulverizing apparatus by collision is extensively increased, and it might be said that utilization of the supercritical fluid, which has a density closer to that of liquid near normal temperature is ideal. Table 1 shows physical properties of helium, which is a gas having high diffusion coefficient, and also of carbon dioxide and water in supercritical state.

TABLE 1

| Mobile phase | State | Temperature (°C.) | Pressure (atm) | Density ($g/cm^3$) | Diffusion coefficient ($cm^2$/sec) | Viscosity (cP) |
|---|---|---|---|---|---|---|
| Helium | Gaseous | 200 | 1.5 | $2 \times 10^{-4}$ | 0.1–1 | 0.02 |
| Carbon dioxide | Low density supercritical | 100 | 80 | 0.15 | $10^{-3}$ | 0.02 |
| | High density supercritical | 35 | 200 | 0.8 | $10^{-3}$ | 0.1 |
| Water | Liquid | 20 | 1 | 1 | $10^{-5}$ | 1 |

The viscosity and diffusion coefficient of the supercritical fluid are between those of gas and liquid, while it is possible to change them extensively by slightly adjusting pressure and temperature. In Table 1, it is possible to easily turn carbon dioxide to the flow of the high density supercritical state or the low density supercritical state. By adjusting diffusion coefficient and viscosity, it is possible to reduce the time for pulverization and to turn them to ultrafine particles.

Further, if pressure is slightly reduced at the time when the substance to be turned to fine particles reaches the desired particle size, the supercritical fluid is vaporized, and the desired fine particles can be instantaneously separated and collected without being re-agglomerated, and there is no need to provide a drying process for drying the fine particles.

The pulverizing apparatus according to the present invention comprises a pulverizing means, by which the fluid having particles dispersed in it is pressurized to high pressure and is crashed as it is injected from a jet nozzle as high velocity flow. However, there is no definitive means for maintaining airtightness and durability of the seal on the sliding portion of the pump, which pressurizes the fluid having solid particles dispersed in it, and it is difficult to pressurize the fluid having solid particles dispersed in it. In the present invention, high pressure seals for general use are arranged face-to-face to each other with a given spacing, and pressure by about 5 to 10% higher than a predetermined pressure necessary for pulverizing is applied by the same supercritical fluid between the seals. As a result, it is possible to place the seal with the same critical fluid having high pressure with very slight differential pressure to the suspension fluid to be pressurized with the sealing material therebetween. Pressure difference before and after is lower when seen from the sealing material, and the suspension liquid side is under lower pressure although slightly. This makes it possible to prevent entry of the solid phase in the suspension liquid into the seals and to extensively improve durability of the apparatus, and also to reduce impurities caused by wearing.

The supercritical fluid usable in the present invention include: carbon dioxide (critical point 31.3° C.; 72.9 atmospheric pressure), sulfur hexafluoride (critical point 45.6° C.; 37.1 atmospheric pressure), ethane (critical point 32.4° C.; 48.3 atmospheric pressure), propane (critical point 96.8° C.; 42.0 atmospheric pressure), dichlorofluoromethane (critical point 111.7° C.; 39.4 atmospheric pressure), ammonia (critical point 132.3° C.; 111.3 atmospheric pressure), butane (critical point 152.0° C.; 37.5 atmospheric pressure), ethylmethylether (critical point 164.7° C.; 43.4 atmospheric pressure), dichlorotetrafluoroethane (critical point 146.1° C.; 35.5 atmospheric pressure), dichlorofluoromethane (critical point 178.5° C.; 51.0 atmospheric pressure), etc. In particular, it is preferable to use carbon dioxide, which is easy to handle.

In the following, more detailed description will be given on the present invention referring to the drawings:

FIG. 1 is a block diagram of a pulverizing apparatus of the present invention. A material adjusting tank 1 is provided with the function to adjust temperature by temperature adjusting means 2, and an agitator 3 is incorporated in it. The agitator is driven by compressed air 4. The powder to be pulverized is charged into the material adjusting tank 1, and a valve 5*a* is opened and the air is evacuated by a vacuum pump 6. Then, the valve 5*a* is closed, and a valve 5*b* is opened to introduce the liquefied carbon dioxide from a liquefied carbon dioxide storage tank 7 into the material adjusting tank 1. After placing the liquefied carbon dioxide of a predetermined quantity, the agitator 3 is rotated to agitate, and temperature is adjusted to a predetermined value by temperature adjusting means.

When almost uniform suspension condition has been reached, a valve 5*c* is opened, and a pressuring pump 8 to pressurize carbon dioxide and driven by compressed air is started to operate, and high pressure generating pumps 9*a* and 9*b* are operated.

After the suspension fluid of the powder passes through a filter 10, temperature is regulated to a predetermined temperature by a heat exchanger 11, and the fluid passes through check valves 12*a* and 12*b* and reaches the high pressure pumps 9*a* and 9*b* and is pressurized to pressure of 30 to 250 MPa. Then, passing through check valves 12*c* and 12*d*, the fluid reaches dispersion pulverizing means 13, by which it is pulverized.

If fine particles are not yet pulverized to a predetermined particle size, a three-way valve 14 is switched over to send the suspension fluid again to the material adjusting tank 1, and the same process is repeated.

In the suspension fluid pulverized by the pulverizing means, pressure is changed, and when this collides, energy is released and heat is generated. For this reason, in case the solid phase substance to be pulverized and dispersed is degenerated or in case it is not wanted to heat beyond the necessary point, it is cooled down using a heat exchanger 15 after processing by the pulverizing means.

After the predetermined pulverizing of the suspension fluid has been completed, the suspension fluid is introduced into a separation tank 16 through a three-way valve 14, and pressure is reduced. When taken out from the pulverizing means, temperature is increased in the suspension fluid. Therefore, when pressure is reduced, it is immediately vaporized, and fine particles can be easily separated. The carbon dioxide gas 17 separated in the separation tank can be used again as liquid carbon dioxide by liquefying by a liquefying apparatus (Japanese patent publication Laid open 7-185404). Fine particles 18 of the dried product can also be obtained from the separation tank. Any type of separation tank may be used if it has a mechanism to reduce pressure. If a separation tank having cyclone function is used, the separated fine particles can be classified immediately according to each particle size.

In this apparatus, it is necessary to maintain the pressure to at least 10 MPa or more in order that the line pressure of the entire apparatus to the separation tank is not reduced to lower than the critical pressure of carbon dioxide.

In this respect, the pressure utilizable for collision by the pulverizing means 13 corresponds to the value, which is obtained by subtracting 10 MPa from the value indicated on a pressure gauge 19.

Figure 2:
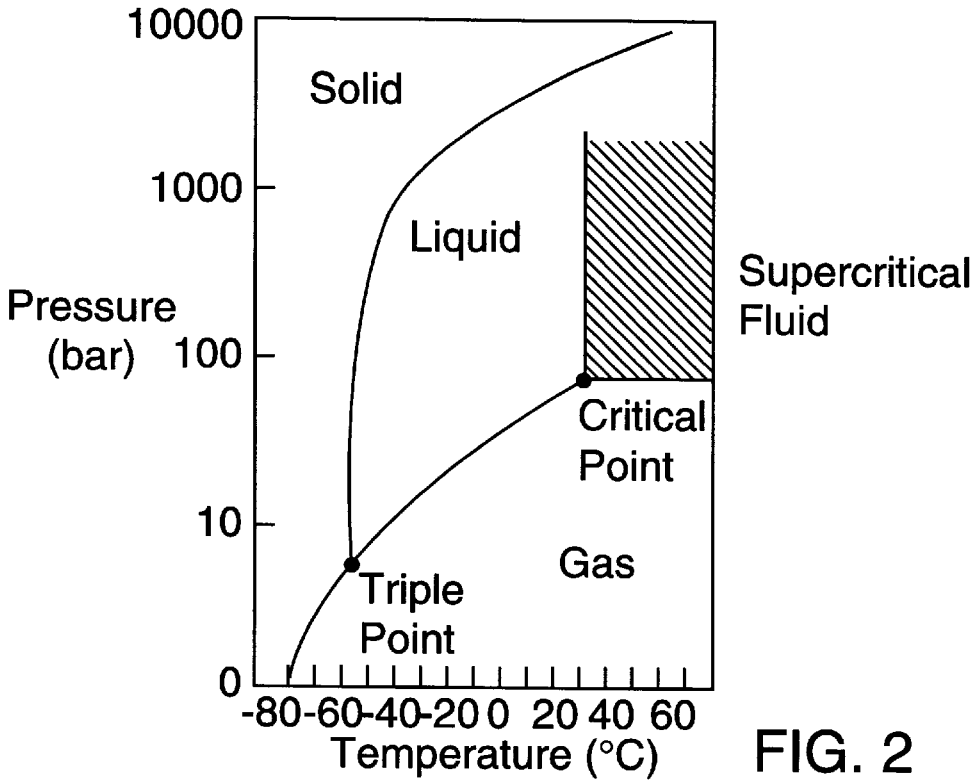
FIG. 2 is a state diagram of carbon dioxide.

In case the supercritical fluid of carbon dioxide ($CO_2$) of the embodiment is used as the suspension medium, as shown in the state diagram of carbon dioxide in FIG. 2, it is kept in supercritical state by maintaining pressure and temperature at 72.9 atmospheric pressure and 31.3° C., and this is easier for maintenance and adjustment as an apparatus. Because it is instantaneously vaporized regardless of temperature, it is not only possible to collect the solid phase pulverized by pressure reduction without agglomerating again, but also to obtain fine particle powder of ultra-high purity because the entire apparatus is a perfect closed system and the suspension fluid is supercritical fluid of very high purity, and neither intermingling of foreign objects nor oxidation of material does occur in the pulverizing process of the material in the apparatus of the present invention.

In the apparatus of the present invention, high pressure is generated by starting hydraulic pumps 21*a* and 21*b* using a motor 20. By generating hydraulic pressure, maximum pressurizing limit of the high pressure generating pumps 9*a* and 9*b* is determined by pressure adjusting apparatuses 22*a* and 22*b*, and the high pressure generating pumps 9*a* and 9*b* are alternately operated through 4-way changeover valves 23*a* and 23*b*. Pressure is regulated by a pressure regulator 24.

Figure 3:
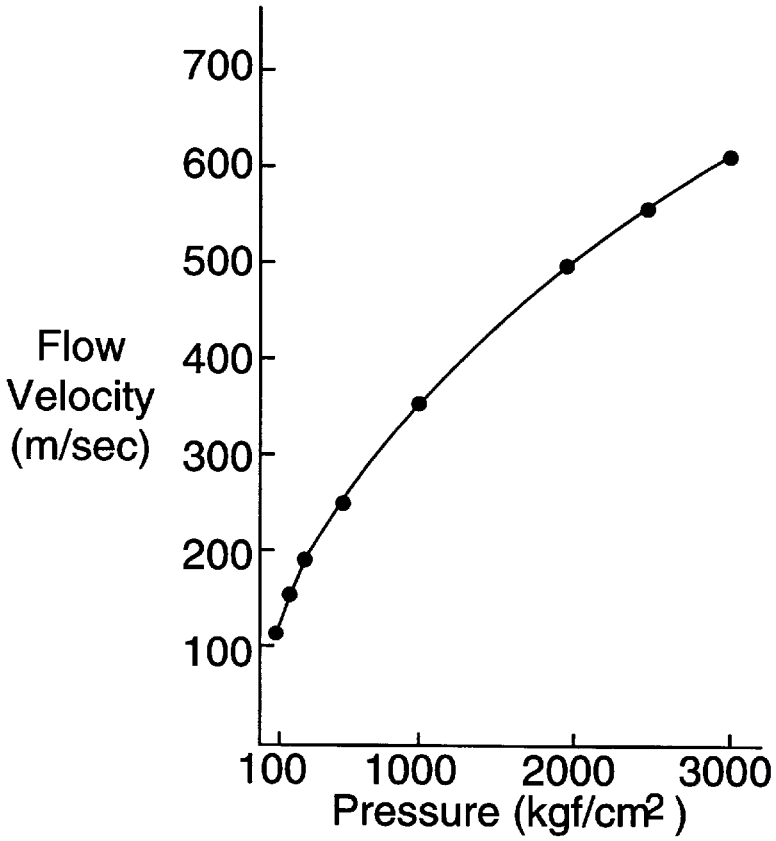
FIG. 3 is a diagram showing the relationship between pressure at an opposed collision nozzle and flow velocity on one side.

On the other hand, as shown in FIG. 3, which explains relationship between the pressure at the opposed collision nozzle and flow velocity on one side, in case it is wanted to obtain fine particle powder by the apparatus of the present invention, the higher the collision speed is, the more efficiently the pulverizing and dispersion are achievable. To attain high speed flow, high pressure can be continuously applied at high efficiency on the pressurizing pump, and long-term durability of the pump is required. In particular, it has been considered almost impossible to manufacture a high pressure generating pump to meet such requirements because the object to be pressurized is the suspension fluid of solid matters.

For such purposes, the high pressure pump can be used, which has been proposed by the present applicants as Japanese Patent Publication Laid-Open 7-185404. In the apparatus of the present invention, it is possible to use the sealing material without replacing it for a long time by designing the sealing portion of the high pressure pump in the following structure.

Figure 4:
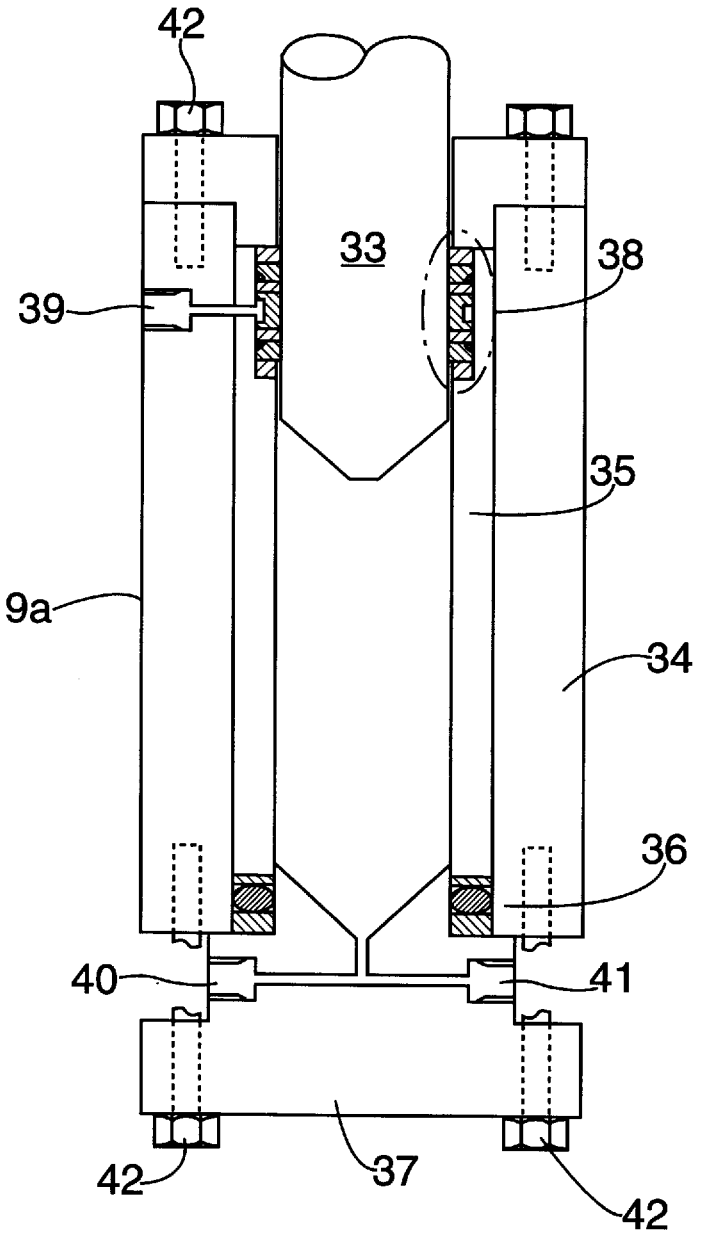
FIG. 4 is a cross-sectional side elevation drawing of a high pressure pump used in the present invention.

FIG. 4 is a drawing of a high pressure pump used in the present invention.

The high pressure pump 9*a* comprises a plunger 33, a cylinder 34, an inner sleeve 35, and a flange 37 provided with attachment for a supply port 40 for suspension fluid and a discharge port 41 for high pressure suspension fluid. The flange 37 and the cylinder 34 are integrally mounted with bolts 42 via a seal 36, which prevents leakage of the high pressure suspension fluid. In FIG. 1, the suspension fluid supplied to the high pressure pump 9*a* via the check valve 12*a* is stagnated in the cylinder, and pressurizing is started when the plunger 33 goes down. In this case, the suspension fluid is pressurized by action of the check valves 12*a* and 12*b* connected to the supply port and the discharge port and is discharged through the check valves 12*c* and 12*d*. Because the pump 9*a* has a small gap between the plunger and the cylinder, a high pressure seal 38 is provided to exclude leakage of the suspension fluid in upward direction. High pressure pump 9*b* acts in a similar manner.

Figure 5A:
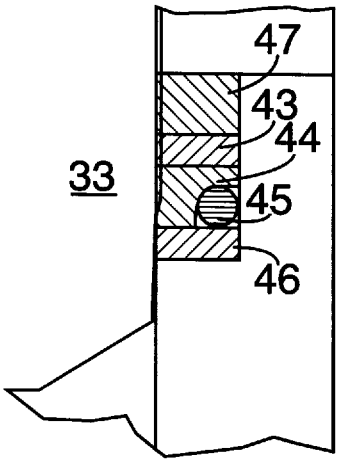
FIG. 5A and 5B are close up cross-sectional views of the plunger of the pump to explain sealing at the high pressure pump.
Figure 5B:
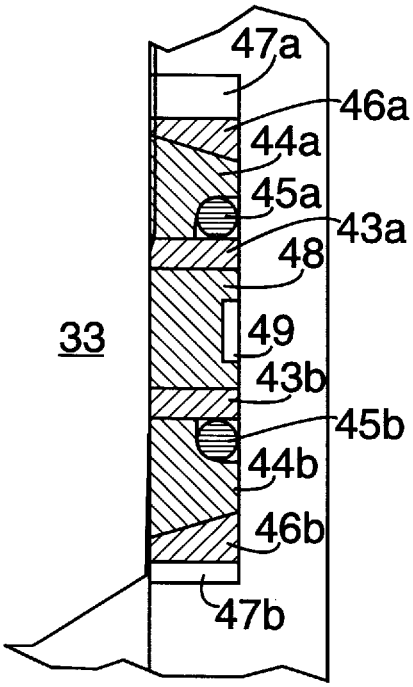

FIG. 5 is to explain the high pressure seals to prevent leakage through a gap between the piston 33 and cylinder 34 in the high pressure pump. FIG. 5 (A) is a cross-sectional view of the seal for explaining a conventional high pressure sealing method.

The high pressure seal deforms a main seal 44 when pressurizing, and the main seal 44 is pushed toward the plunger 33, and it comprises an O-ring 45 to achieve perfect sealing and a plurality of backup rings 43, 46 and 47 to prevent deformation due to pressure and to ensure long-term durability. The mixed phase fluid attached to the plunger passes through the main seal 44 and is forced to flow out toward the backup rings 43 and 47 arranged on the low pressure side. As a result, the solid phase components in the mixed phase fluid are attached or fixed to the main seal 44. For this reason, despite tremendous efforts to have an adequate material and shape, a decrease of durability of seal or flaws or damages of plunger occurs due to friction of the solid phase components attached when the plunger 33 is repeatedly moved up and down, and it is unavoidable to replace these parts at an earlier time.

FIG. 5 (B) is a cross-sectional view of the sealing components in the high pressure pump of the present invention. Main seals 44*a* and 44*b* comprise backup rings 43*a*, 43*b*, 46*a*, 46*b*, 47*a* and 47*b*, O-rings 45*a* and 45*b*, and a guide ring 48. The supercritical fluid used as a pressurizing medium is introduced through a pressurizing medium supply port 30 of the high pressure pump of the present invention shown in FIG. 4 by adjusting the pressure by 5 to 10% higher than the pressurizing pressure required in the high pressure pump. The supercritical fluid thus introduced is filled in a groove 49 provided around the guide ring 48. At the same time, the main seals 44*a* and 44*b* are deformed by pressurizing, and the main seals 44*a* and 44*b* are constantly and strongly pressed toward the plunger side.

Even when the plunger 33 starts to go down, the pressure is by 5 to 10% higher than the preset pressure in the cylinder. By the preset pressure on the sealing unit, the suspension fluid does not leak upward from main gasket seal 44*b*. After the plunger reaches the lower dead center and starts to go up, the suspension fluid attached to the plunger cannot go upward from the main seal 44*b* because high pressure is constantly applied between the main seals 44*a* and 44*b*.

Therefore, there occurs neither intrusion nor fixation of solid phase components into the main seal, and it is possible to improve durability of main gasket and plunger.

In the suspension fluid under supercritical state pressurized by the high pressure pump of the present invention, opposed collision of the suspension fluid in supercritical state is performed at high speed by the pulverizing means and it is turned to fine particles.

Figure 6:
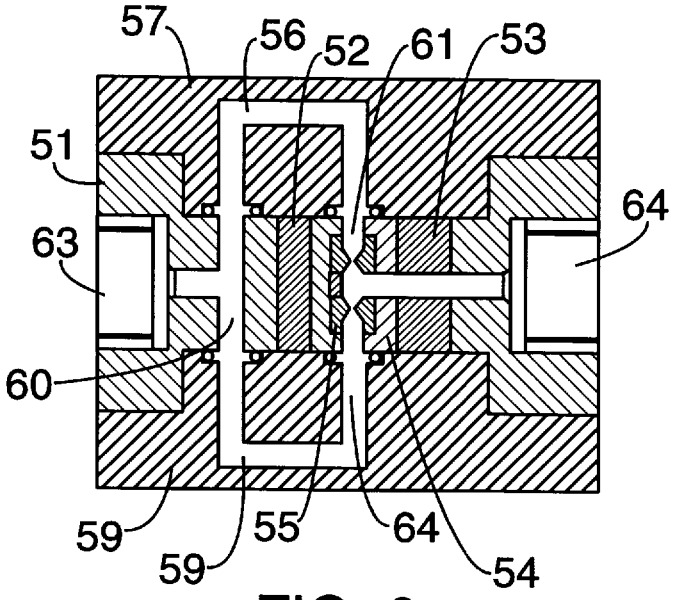
FIG. 6 is a cross-sectional drawing of an example of a dispersion pulverizing means.

FIG. 6 is a cross-sectional view of an example of the pulverizing means.

In a space provided in a pressure vessel main unit 51, made of stainless steel durable to high pressure fluid, there is provided between metal seal pieces 52 and 53 a pulverizing means main body 55 made of tungsten carbide and incorporated with a pulverizing unit 54 made of diamond. An upper lid 57 having a flow passage 56 and a lower lid 59 having a flow passage 58 are connected with the pressure vessel main unit 51, and flow passage 60 on the pressure vessel main unit side is communicated with flow passages 61 and 62 on the pulverizing means main body side. The inflow side and outflow side are connected by high pressure metal seal couplings respectively.

Figure 7A:
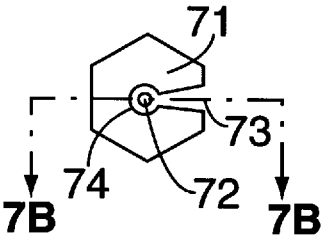
FIGS. 7A, 7B and 7C are close up views of the main body of the pulverizing unit, to explain an example of the structure of the dispersion pulverizing unit.
Figure 7C:
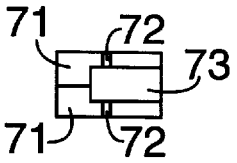
Figure 7B:
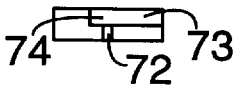

FIG. 7 represents details of the structure of an example of the pulverizing unit formed with two members. FIG. 7 (A) is a plan view of the main body of the pulverizing unit, and FIG. 7 (B) is a cross-sectional view along the line A—A of FIG. 7 (A). FIG. 7 (C) represents a pulverizing unit, which is obtained by combining two pulverizing unit main bodies having the same structure. The pulverizing unit main body 71 is provided with a through-hole 72, and a groove 73 serving as a flow outlet is formed. On the side of the through-hole of the pulverizing unit main body opposite to flow outlet, an extension 74 with a larger diameter is formed to ensure even pulverizing and emulsification. At the same time, it is attempted to minimize damage of the pulverizing unit caused by collision against the wall surface of the fluid to be pulverized.

Figure 8A:
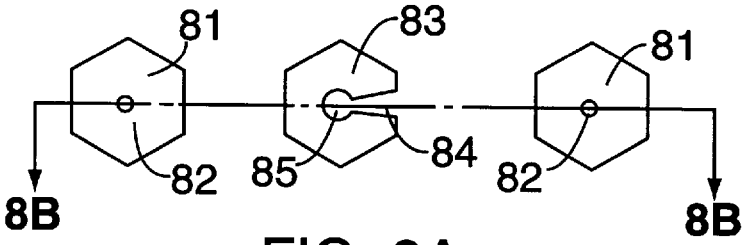
FIGS. 8A, 8B and 8C are close up views of the compositon of the pulverizing unit to explain another example of the structure of the dispersion pulverizing unit.
Figure 8B:
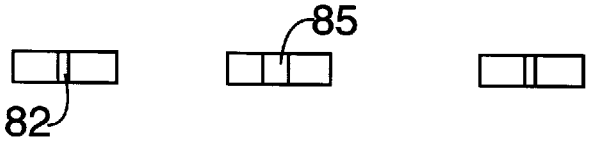
Figure 8C:
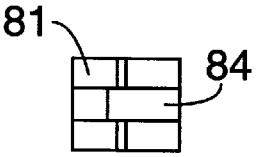

FIG. 8 represents details of the structure of an example of a pulverizing unit where three members are laminated. FIG. 8 (A) is a plan view of each of the component members, and FIG. 8 (B) is a cross-sectional view along the line B—B of each member shown in FIG. 8 (A). FIG. 8 (C) shows an emulsifying unit where an intermediate member is laminated between the end members.

On an end plate 81 of the dispersion pulverizing unit, a through-hole 82 is formed, and an extension and a flow outlet 84 are provided on an intermediate plate 83 in order to minimize damage of the pulverizing unit due to collision against a wall surface of the fluid to be emulsified and dispersed.

Figure 9:
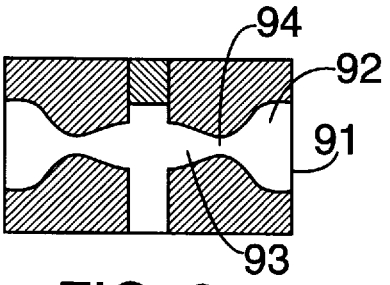
FIG. 9 is a cut away sectional view drawing of an example of a nozzle for suspension fluid.

Further, from the flow inlet of the pulverizing unit to a collision portion, an orifice is formed, the cross-sectional area of which along a plane perpendicular to the central axis of flow passage is gradually decreased from the inlet of the flow passage toward the outlet. By providing an area where there is no particle from the portion of the orifice with minimal diameter toward the outlet, wearing of the wall surface by the particles can be prevented. A cross-sectional view of an example of such a nozzle is shown in FIG. 9. An orifice 94 is formed between an inflow side 92 and an outflow side 93, and cross-sectional area of channel is gradually decreased toward the orifice 94. In this example, a channel of 2.2 mm in size is formed on the inflow side, and cross-sectional area of the channel is gradually decreased toward the orifice of 0.23 mm in diameter for a length of 1.15 mm. As a result, on the downstream side of the orifice, a region is provided where no solid particle is present, and damage of the wall surface is prevented.

EXAMPLE 1

As a fluid in supercritical state, silicon carbide (SiC) was suspended by 30 weight % in carbon dioxide under the pressure of 100 kgf/cm$^2$, at 40° C., and the pressure was increased to 2000 kgf/cm$^2$ by a high pressure pump. This was branched off to two flow passages in a pressure-tight case. Then, this was pulverized by opposed collision when it was injected through an acceleration nozzle of 0.23 mm in diameter made of diamond, and the fluid was discharged through the central portion. Discharge quantity was 2.3 liters/min. The opposed collision speed was 462 m/sec., and the relative speed was 924 m/sec. The suspension fluid taken out of the pulverizing unit was cooled down to 40° C. using a heat exchanger and was then sent to a material adjusting tank. This pulverizing process was performed by three times in all. After taken out of the pulverizing unit on the third time, pressure on the suspension fluid was reduced in a separation tank, and the supercritical fluid was vaporized and fine particles were separated.

When the fine particles thus obtained were examined under scanning electron microscope, particles having a particle diameter of 10 $\mu$m were found as turned to particle size of 1 $\mu$m, and primary particles were not in agglomeration.

COMPARATIVE EXAMPLE 1

Silicon carbide of 10 $\mu$m in particle size was suspended by 15 weight % in water, and pressure was increased to 2500 kgf/cm$^2$. Then, this was pulverized by the same pulverizing unit as in Example 1. This process was repeated by 15 times, and solid particles were separated by drying. Primary particles had particle size of 2 to 3 $\mu$m, but agglomeration size was about 10 $\mu$m.

As described above, according to the pulverizing by the apparatus of the present invention, it is possible to perform efficient pulverizing because a supercritical fluid having a higher diffusion coefficient and lower viscosity is used as a suspension medium. Because the suspension fluid can be easily separated with the supercritical fluid as gas by reducing pressure on the suspension fluid, there is no need to have a drying process, and no agglomeration of fine particles occurs in the drying process. Thus, fine particles having a desired particle size can be obtained.

What I claim is:

1. A method for pulverizing solid particles, comprising the steps of suspending the solid particles into a fluid under supercritical or subcritical state, which is in gaseous state at normal temperature, pressurizing the suspension fluid, dispersing and pulverizing the high pressure suspension fluid thus obtained by injecting the fluid through a nozzle causing collisions between said solid particles at high speed, reducing pressure in the suspension fluid, and separating the fluid under supercritical or subcritical state as a gas from the solid particles.

2. An apparatus for pulverizing solid particles, comprising a material adjusting a suspension fluid where solid particles are suspended in a fluid under supercritical or subcritical state, which is in gaseous state at normal temperature, a pressurizing means for pressurizing the suspension of fluid, a dispersing and pulverizing means by injecting the pressurized suspension fluid through a nozzle and causing said presolid particles to collide at high speed, and a separating means for separating solid particles by reducing pressure on the suspension fluid.

* * * * *